US009427038B2

(12) United States Patent
Bundy et al.

(10) Patent No.: US 9,427,038 B2
(45) Date of Patent: Aug. 30, 2016

(54) SUN/RAIN HAT

(71) Applicant: Shore Sunhats, LLC, Dallas, TX (US)

(72) Inventors: Tracy M. Bundy, Dallas, TX (US); Donna M. Morrow, New York, NY (US); Kim M. Laguzza, New Canaan, CT (US)

(73) Assignee: SHORE SUNHATS, LLC, Dallas, TX (US)

( * ) Notice: Subject to any disclaimer, the term of this patent is extended or adjusted under 35 U.S.C. 154(b) by 116 days.

(21) Appl. No.: 13/655,550

(22) Filed: Oct. 19, 2012

(65) Prior Publication Data

US 2013/0174321 A1 Jul. 11, 2013

Related U.S. Application Data

(60) Provisional application No. 61/583,481, filed on Jan. 5, 2012.

(51) Int. Cl.
*A42B 1/18* (2006.01)
*A42B 1/24* (2006.01)

(52) U.S. Cl.
CPC *A42B 1/18* (2013.01); *A42B 1/241* (2013.01)

(58) Field of Classification Search
CPC ..... A42B 1/18; A42B 1/241; A42B 1/041; A42B 1/008; A42B 1/04; A42B 1/201; A42B 1/045
USPC ..... 2/175.1, 175.5–175.7, 183, 207, 2/209.11, 209.12, 20.13
See application file for complete search history.

(56) References Cited

U.S. PATENT DOCUMENTS 946,770 A * 1/1910 Sands ..... 2/68
1,393,652 A * 10/1921 Van Huele ..... 2/181
2,986,741 A * 6/1961 Brasington, Jr. ..... A42B 1/067 2/172
4,165,542 A * 8/1979 McLaughlin ..... 2/209.13
4,378,606 A * 4/1983 Snowden ..... A42B 1/041 2/200.1
5,048,128 A * 9/1991 Watson, Jr. ..... 2/204
5,323,491 A * 6/1994 Barrett, Jr. ..... 2/207
5,477,561 A * 12/1995 Adkins ..... A42B 1/041 2/171.04
5,488,740 A * 2/1996 Garza ..... 2/175.1
5,860,165 A * 1/1999 Cvijanovich ..... A42B 1/241 2/172
5,887,287 A * 3/1999 Potochnik ..... A42B 1/241 2/172
6,012,172 A * 1/2000 Steffy ..... 2/175.1
6,216,278 B1 * 4/2001 Nguyen ..... B32B 15/08 2/174
6,230,330 B1 * 5/2001 Steffy ..... 2/175.1
6,311,336 B1 * 11/2001 Gootrad ..... A41D 27/208 150/107
6,317,892 B1 * 11/2001 Galigani ..... 2/209.11
6,467,096 B1 * 10/2002 Coluccio ..... A42B 1/22 2/171
7,117,542 B2 * 10/2006 Lee ..... 2/181
7,310,829 B1 * 12/2007 Engel-Wilson ..... 2/209.13
8,627,515 B1 * 1/2014 Scott ..... 2/175.1

(Continued)

*Primary Examiner* — Khoa Huynh
*Assistant Examiner* — Megan Brandon
(74) *Attorney, Agent, or Firm* — Sheppard, Mullin, Richter & Hampton LLP

(57) ABSTRACT

A sun/rain hat comprising a crown having a base, a brim extending outwardly from the base, and a liner coupleable to the crown. The liner has a posterior pouch therein configured to contain a prominent mass of hair and protect same from water or other elements.

19 Claims, 3 Drawing Sheets

(56) References Cited

U.S. PATENT DOCUMENTS

| | | | | |
|---|---|---|---|---|
| 2001/0025385 | A1* | 10/2001 | Montague | 2/175.2 |
| 2004/0154074 | A1* | 8/2004 | Yan | 2/209.11 |
| 2005/0028247 | A1* | 2/2005 | Kim | 2/183 |
| 2007/0083981 | A1* | 4/2007 | Cho | 2/175.1 |
| 2007/0204384 | A1* | 9/2007 | Carey | 2/207 |
| 2008/0066214 | A1* | 3/2008 | O'Hare | 2/172 |
| 2008/0083053 | A1* | 4/2008 | Lin | 2/422 |
| 2010/0107318 | A1* | 5/2010 | Asta | 2/424 |
| 2010/0186147 | A1* | 7/2010 | Garza | 2/209.12 |
| 2011/0099691 | A1* | 5/2011 | Duwyn-Zylstra | 2/175.1 |
| 2011/0107500 | A1* | 5/2011 | Wathen | 2/207 |
| 2011/0145977 | A1* | 6/2011 | Oates | 2/182.8 |
| 2012/0023642 | A1* | 2/2012 | Holland | 2/207 |
| 2012/0180193 | A1* | 7/2012 | Curiel | 2/209.11 |

* cited by examiner

SUN/RAIN HAT

CROSS-REFERENCE TO RELATED APPLICATION

This application claims the benefit of U.S. Provisional Application Ser. No. 61/583,481, filed by Tracy M. Bundy on Jan. 5, 2012, entitled "Sun Hat," commonly assigned with this application and incorporated herein by reference.

TECHNICAL FIELD

This application is directed, in general, to headgear and, more specifically, to a sun/rain hat.

BACKGROUND

Various types of hats, helmets and other head gear have heretofore been developed by numerous individuals to protect themselves from the sun and other elements. What is needed in the art is a new hat that accommodates the ever changing desires of the user and their hairdos.

SUMMARY

One aspect provides a sun/rain hat comprising a crown having a base, a brim extending outwardly from the base, and a liner coupleable to the crown. The liner has a posterior pouch therein configured to contain a prominent mass of hair and protect same from water or other elements.

BRIEF DESCRIPTION

Reference is now made to the following descriptions taken in conjunction with the accompanying drawings, in which.

DETAILED DESCRIPTION

The present disclosure is based, at least in part, on the acknowledgment that today, may women find it necessary to protect not only their facial skin, but also their coiffures from the drying and bleaching effects of the sun. The present disclosure has further acknowledged, that there is a present desire by many women to enjoy the outdoors in the presence of water, such as the beach at lakes or the ocean, as well as poolside at home or while traveling. Having made this acknowledgment, the present disclosure recognized that oceanside or poolside activities may infiltrate hair with water, which may also contain salt or chlorine, all of which can be damaging elements to a lady's coiffure. In addition, the present disclosure also recognized rain and other inclement weather as having damaging effects on a women's coiffure.

Figure 1:
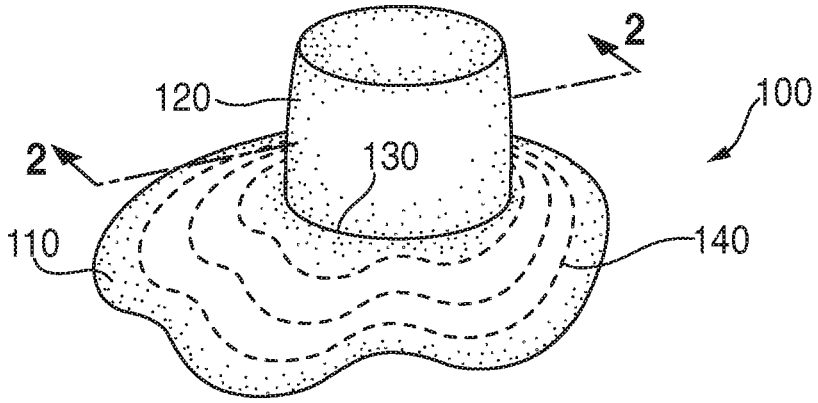
FIG. 1 is a front perspective view of one embodiment of a sun/rain hat constructed according to the principles of the present disclosure.

Referring initially to FIG. 1, illustrated is a front perspective view of one embodiment of a sun/rain hat 100 constructed according to the principles of the present disclosure. The sun/rain hat 100 comprises a brim 110, a crown 120 coupled together at a base 130, and stitching 140. For packing convenience, the overall construction of the sun/rain hat 100 may be from highly flexible materials so that the sun/rain hat 100 may be readily crushed, rolled, or otherwise packaged for inclusion in luggage, beach bag, etc. In one embodiment, the sun/rain hat 100 primarily comprises cotton, but in other embodiments the sun/rain hat 100 primarily comprises straw, linen, or any form of synthetic material or any combination thereof, among others.

Figure 2:
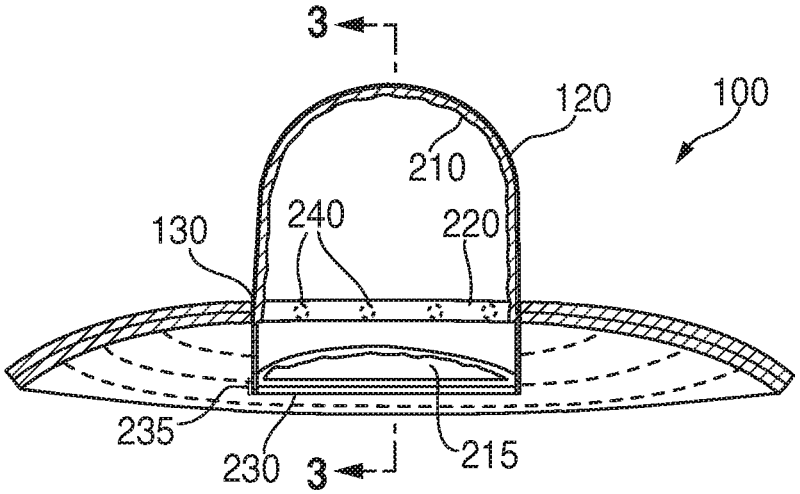
FIG. 2 is a sectional view along plane 2-2 of the sun/rain hat of FIG. 1.

Referring now to FIG. 2, illustrated is a sectional view along plane 2-2 of the sun/rain hat 100 of FIG. 1. The sun/rain hat 100 may further comprise a liner 210 having a posterior pouch 215, a sweat band 220, a liner terminus 230 and a headband 235. The liner 210, in one embodiment, is a water-resistant liner. In another embodiment, the liner 210 is a water-proof liner. The term water-proof, as used herein with regard to the liner 210, means the liner substantially prevents water that may come from a pool or ocean, as well as water that may come from inclement weather, from coming into contact with a user's hair contained within the liner 210.

In one embodiment, the liner 210 may be water resistant. In a particular embodiment, the liner 210 may comprise nylon or other similar material. In a preferred embodiment, the liner 210 comprises ripstop nylon. Ripstop nylon is a woven nylon fabric using a special reinforcing technique of interweaving reinforcement threads at regular intervals in a crosshatch pattern throughout the fabric that makes the nylon resistant to tearing, ripping and the effects of water. The rip-stop nylon may be a lightweight, and water-proof or water-resistant breathable fabric, in which small tears cannot easily spread. The rip-stop nylon may have a variety of different denier values and remain within the purview of the disclosure. In one embodiment, however, the denier value for the rip-stop nylon ranges from about 30 to about 2100, and in another embodiment from about 60 to about 80. Having entertained various different denier values, a denier value of about 70 provides unexpected results. Nevertheless, the present disclosure should not be limited to any specific denier value.

The liner 210 may be coupled to the sun/rain hat 100 (e.g., the base 130 in this embodiment) in a variety of ways. In one desirable embodiment, the liner 210 is removeably coupled to the base 130 with hook-and-loop fasteners, commonly known as Velcro®, a product of Velcro USA Inc., of Manchester, N.H. In alternative embodiments, the liner 210 may be removeably coupled to the base 130 with snaps 240 or with traditional hook and eye fasteners positioned around the base 130. In a more permanent embodiment, the liner 210 may be stitched directly to the base 130. One who is of skill in the art may readily develop other methods by which the liner 210 may be coupled to the base 130.

In a preferred embodiment, the liner 210 may have a terminus 230 equipped with an elastic headband 235 to cause the liner 210 to be substantially watertight. To form the elastic headband 235, a portion of the liner terminus 230 may be folded upon itself with an elastic material sown therein. In an alternative embodiment the terminus 230 may be equipped with a drawstring headband 250 (not shown in this view) that ties, for example at the rear. With the liner 210 being substantially watertight, the wearer may with reasonable caution enter a swimming pool or lake/ocean, or walk in the rain or other inclement weather, while still protecting an expensive hairdo.

Figure 3:
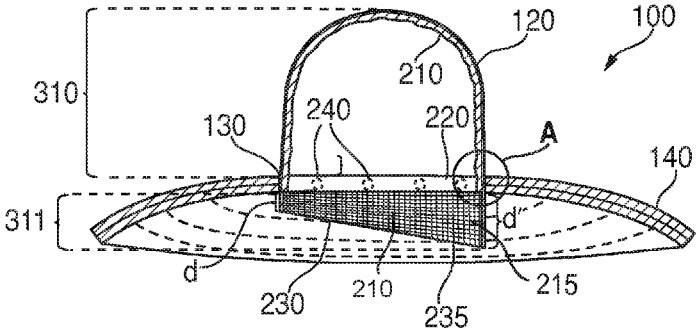
FIG. 3 is a sectional view of the sun/rain hat along plane 3-3 of FIG. 2.
Figure 5:
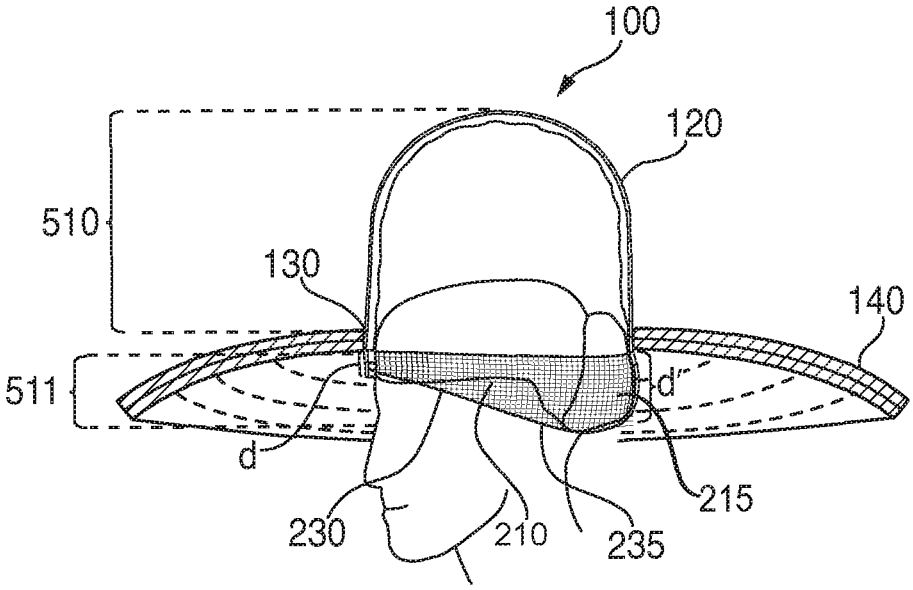
FIG. 5 is a partial cross-sectional, side perspective view of the sun/rain hat as it would be worn by a wearer with a prominent mass of hair contained within the posterior pouch.

Referring now to FIG. 3, illustrated is a sectional view of the sun/rain hat 100 along plane 3-3 of FIG. 2, and FIG. 5, which illustrates the sun/rain hat in a similar view as FIG. 3, with the additional illustration of the wearer's head. In a preferred embodiment, the liner 210 may have an in-crown portion 310 and a below-crown portion 311. In one embodiment, the in-crown portion 310 may substantially fill the crown 120. In a particularly embodiment, the below-crown portion 311 extends below the crown 120 around an entire circumference of the head of a wearer for a distance d at the front of the sun/rain hat 100 and extends below the crown 120 for a distance d' at the rear of the sun/rain hat 100, wherein d<d'. This configuration where d<d' creates the posterior pouch 215 and allows for the wearer to fully cover their hair substantially down to the nape of the neck, while keeping the forehead relatively clear. Of course, in this embodiment the liner 210 will vary in length from the front d to the rear d'. Additionally, the length of the rear d' may be varied to accommodate larger or smaller prominent masses of hair. In one example embodiment, the distance d ranges from about 6 mm to about 55 mm, and the distance d' ranges from about 100 mm to about 180 mm.

Figure 4:
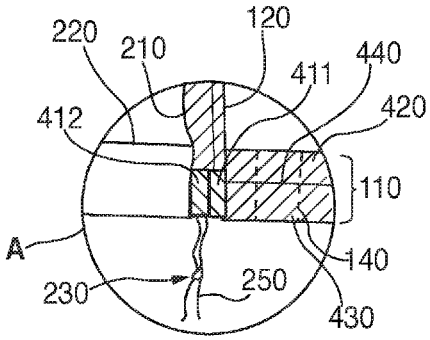
FIG. 4 is an expanded view of the area designated A in FIG. 3.

Referring now to FIG. 4, illustrated is an expanded view of the area designated A in FIG. 3 of an alternative embodiment. This close up view reveals the alternate embodiment of the sun/rain hat 100 wherein the crown 120, brim 110 and loop fastener tape 411 are coupled at the base 130 as a first assembled unit. The liner 210, hook fastener tape 412, and the sweat band 220 are joined as a second assembled unit. This configuration provides for the removal of the liner 210 from the first assembled unit so that the crown 120 and brim 110 may be laundered. In this embodiment, the second assembled unit is removeably coupleable to the first assembled unit using the hook fastener tape 412 in cooperation with the loop fastener tape 411.

In the illustrated embodiment, the brim 110 comprises an upper layer 420, a lower layer 430 and an interlayer 440. The upper layer 420 and the lower layer 430 may be constructed of the same material as the crown 120. That is, the upper layer 420, the lower layer 430 and the crown 120 may comprise a water-resistant fabric or a UV-resistant fabric. One who is of skill in the art will readily identify water-resistant and UV-resistant fabrics suitable for this application, such as the Sunbrella® fabric, a product of Glen Raven, Inc., Glen Raven, N.C.

In one embodiment, the interlayer 440 may comprise poly mesh or other such interfacing material. Poly mesh is an open weave fabric made from polyester fiber which may have additional treatment(s) for a specific use. The drawstring 250 as mentioned above is shown as it might exit the folded terminus 230 at the rear of the below-crown portion 311. In one embodiment, the upper layer 420, lower layer 430 and interlayer 440 are stitched 140 together to form the brim 110. In one particular embodiment, the stitching is in the substantial form of a portion of an Archimedean spiral (See FIG. 1). That is, beginning at the base and proceeding around the brim 110, the stitching is in a continuous line remaining substantially equidistant from the next innermost line. The Archimedean spiral has the property that any radial from the origin intersects successive turnings of the spiral in points with a constant separation distance. In another embodiment, the stitching takes the form of a plurality of concentric circles. For example, depending on the size of the brim 110, anywhere from about 4 to about 7 concentric circles might be used. The brim 110 may be sized so that it will lay flat upon a horizontal surface or alternatively, the brim 110 may be somewhat undersized so that it forms a surface similar to a portion of a cone, thereby providing greater sun protection for the wearer.

Thus, a sun/rain hat has been described having a water resistant liner with a posterior pouch suitable to collect and protect a prominent mass of hair. The liner, in one embodiment, may also be UV resistant. The sun/rain hat may further have either an elastic headband or a drawstring headband to secure the liner around the wearer's head.

Those skilled in the art to which this application relates will appreciate that other and further additions, deletions, substitutions and modifications may be made to the described embodiments.

What is claimed is:

1. A sun/rain hat, comprising:

a crown having a base;

a brim extending outwardly from said base that circumferentially encircles the base; and a liner coupled to the crown, the liner having an in-crown portion substantially filling the crown and a below-crown portion which extends below the base in a rear of the hat a greater distance than in the front of the hat, the below crown portion ending at a liner terminus which is configured to encircle a head of a wearer from a forehead to a nape of a neck of the wearer, wherein the liner terminus includes a circumferential headband configured to secure the liner terminus around the entire circumference of the head of the wearer and to collect a mass of hair; and an internal band coupled to said liner on an inside of said liner.

2. The sun/rain hat as recited in claim 1 wherein said liner is stitched to said crown at said base.

3. The sun/rain hat as recited in claim 1 wherein said liner is removably coupleable to said crown at said base.

4. The sun/rain hat as recited in claim 3 wherein said liner is removably coupleable to said crown with hook-and-loop fasteners.

5. The sun/rain hat as recited in claim 3 wherein said liner is removably coupleable to said crown with snaps.

6. The sun/rain hat as recited in claim 1 wherein said liner is water resistant.

7. The sun/rain hat as recited in claim 1 wherein said liner comprises nylon.

8. The sun/rain hat as recited in claim 1 wherein said liner comprises rip-stop nylon.

9. The sun/rain hat as recited in claim 1 wherein said headband is an elastic headband.

10. The sun/rain hat as recited in claim 1 wherein the headband is a drawstring headband.

11. The sun/rain hat as recited in claim 1 wherein the internal band is a sweat band.

12. The sun/rain hat as recited in claim 1 wherein the below crown portion extends downward from about 6 mm to about 55 mm in the front of the hat, and from about 100 mm to about 180 mm in the rear of the hat.

13. The sun/rain hat as recited in claim 1 wherein said crown and said brim comprise water-resistant fabric or UV-resistant fabric.

14. The sun/rain hat as recited in claim 1 wherein said brim comprises an upper layer, an interlayer and a lower layer.

15. The sun/rain hat as recited in claim 14 wherein said crown and said upper layer comprise UV-resistant fabric or water-resistant fabric.

16. The sun/rain hat as recited in claim 14 wherein said interlayer comprises poly mesh.

17. The sun/rain hat as recited in claim 1 wherein said brim has reinforcing stitching in a pattern therethrough wherein said pattern describes a portion of an Archimedean spiral.

18. The sun/rain hat as recited in claim 1 wherein said brim has reinforcing stitching in a pattern therethrough wherein said pattern consists of a plurality of concentric circles.

19. The sun/rain hat as recited in claim 1, wherein the liner terminus is further configured to form a posterior pouch configured to protect the mass of hair.

* * * * *